US006433336B1

(12) United States Patent
Jongen et al.

(10) Patent No.: US 6,433,336 B1
(45) Date of Patent: Aug. 13, 2002

(54) DEVICE FOR VARYING THE ENERGY OF A PARTICLE BEAM EXTRACTED FROM AN ACCELERATOR

(75) Inventors: Yves Jongen, Louvain-la-Neuve; Vincent Poreye, Ramillies, both of (BE)

(73) Assignee: Ion Beam Applications S.A., Louvain-La-Neuve (BE)

( * ) Notice: Subject to any disclaimer, the term of this patent is extended or adjusted under 35 U.S.C. 154(b) by 0 days.

(21) Appl. No.: 09/868,461

(22) PCT Filed: Dec. 20, 1999

(86) PCT No.: PCT/BE99/00166

§ 371 (c)(1),
(2), (4) Date: Jun. 18, 2001

(87) PCT Pub. No.: WO00/38486

PCT Pub. Date: Jun. 29, 2000

(30) Foreign Application Priority Data

Dec. 21, 1998 (BE) ..... 9800913

(51) Int. Cl.[7] ..... H05H 7/12; H05H 13/04

(52) U.S. Cl. ..... 250/305; 250/505.1; 315/503; 315/500

(58) Field of Search ..... 250/305, 505.1; 315/503, 500

(56) References Cited

U.S. PATENT DOCUMENTS 6,268,610 B1 * 7/2001 Pu ..... 250/492.3

OTHER PUBLICATIONS

Berg, R.E., "Rotating Wedge Cyclotron Beam Degrader", Proc. 7$^{th}$ Int. Conf. on Cyclotrons and their Applications (Birkhauser, Basel, 1975), p. 315–316.

Shimoda, T. et al, "Design study of the secondary–beam line at RCNP", Nuclear Instruments and Methods in Physics Research B70 (1992), p. 320–330.

Constantinescu, V. et al, "Radiation Damage and Surface Deformation Effects on Stainless Steel Produced by Helium–Ion Bombardment", Journal of Nuclear Materials, (1985), p. 105–109.

Kanai, T. et al, "Three–Dimensional Beam Scanning for Proton Therapy", Nuclear Instruments and Methods 214 (1983), p. 491–496.

Werbeck, R.D. et al, "Performance of the High–Energy Pion Beam at LAMPF", IEEE Transactions on Nuclear Science, vol. NS–22, No. 3, Jun. 1975.

(List continued on next page.)

*Primary Examiner*—Bruce Anderson
*Assistant Examiner*—Nikita Wells
(74) *Attorney, Agent, or Firm*—Alix, Yale & Ristas, LLP

(57) ABSTRACT

A device for varying the energy of a particle beam extracted from a fixed-energy particle accelerator includes a block of energy degrading material positioned in the path of the particle beam. The block of energy degrading material is preferably in the form of a ring arranged on a wheel. The ring is of a staircase configuration, having discrete steps defining a thickness between parallel entry and exit faces. According to one aspect of the invention, the block is configured so that the particle beam energy variation reaches a maximum at the edges of each step. This upper limit is also the lower limit of the next step. Thus, continuous energy variation is possible despite the fact that the thickness of the block varies in discrete steps.

13 Claims, 3 Drawing Sheets

OTHER PUBLICATIONS

Kanai, T. et al: "Three–dimensional beam scanning for proton therapy"; Nuclear Instruments and Methods in Physics Research, Sep 1, 1983; Netherlands; vol. 214, No. 2–3, pp. 491–496.

Werbeck, R.D. et al.: "Performance of the high–energy pion beam at LAMPF" 1975 Particle Accelerator Conference, Washington, DC, USA; 12–14 Mar. 1975, vol. ns–22, No. 3, pp. 1598–1600.

Constantinesque, B. et al.: "Radiation damage and surface deformation effects on stainless steel produced by helium–ion bombardment", JOURNAL OF NUCLEAR MATERIALS, JUN. 1985, Netherlands, vol. 132, No. 2, pp. 105–109.

Shimoda, T. et al.: "Design study of the secondary–beam line at RCNP" TWELFTH INTERNATIONAL CONFERENCE ON ELECTROMAGNETIC ISOTOPE SEPARATORS AND TECHNIQUES RELATED TO THEIR APPLICATIONS, SENDAI, JAPAN 2–6 Sep. 1991, vol. B70, No. 1–4, pp. 320–330.

Berg, R.E.: "Rotating wedge cyclotron beam degrader" $7^{th}$ INTERNATIONAL CONFERENCE ON CYCLOTRONS AND THEIR APPLICATIONS, ZURICH, SWITZERLAND, 10–22 aGU. 1975, pp. 315–316.

* cited by examiner

DEVICE FOR VARYING THE ENERGY OF A PARTICLE BEAM EXTRACTED FROM AN ACCELERATOR

CROSS REFERENCE TO RELATED APPLICATIONS

This is the U.S. national phase of International Patent Application No. PCT/BE99/00166 filed Dec. 20, 1999, which claims priority of Belgian Patent Application No. 9800913, filed Dec. 21, 1998.

BACKGROUND OF THE INVENTION

1. Field of the Invention

The present invention relates to a device for varying the energy of a particle beam extracted from a particle accelerator.

The present invention also relates to the use of said device.

2. State of the Art

Certain applications involving the use of beams of charged particles also require the energy of these particles to be rapidly varied.

To do this, one solution consists in using an accelerator capable of producing, intrinsically, an extracted particle beam whose energy is variable. In this regard, it may be proposed to use an accelerator such as a synchrotron capable of producing within this accelerator itself a particle beam, the energy of which is variable. Nevertheless, this type of accelerator is relatively complex to produce, and is accordingly more expensive and less reliable than particle accelerators which produce beams of fixed energy such as cyclotrons.

As a result, it has been proposed to equip such fixed-energy accelerators with a device whose function is to modify the energy characteristics of the beam, and to do so over the trajectory of said beam extracted from the accelerator. These devices are based on the well-known principle according to which any particle passing through a block of material undergoes a decrease in its energy by an amount which is, for particles of a given type, a function of the intrinsic characteristics of the material passed through and its thickness.

Nevertheless, the main drawback of such devices, which are also known as energy degraders, lies in the fact that the block of material deteriorates the energy resolution of the degraded beam. This is due to a phenomenon which is also known as "straggling", which generates a static energy variation of more or less 1.5%. By proposing an entry face and an exit face that are parallel within the energy degrader, this phenomenon tends to be reduced.

In addition, it is observed that the optical characteristics of the beam passing through the energy degrader are also altered. In particular, a parallel incident beam becomes divergent when leaving the degrader because of the multiple scattering within the degrader. These drawbacks (increase in divergence and in energy dispersion) may lead to a situation in which the emittance of the beam is too high to meet the entry emittance constraints set by the optical elements of the beam which are located downstream along the beam transport line.

In order to solve these problems, it has also been proposed to use an analysis magnet placed after the degrader device, which is intended to accept only the energy desired for a predetermined resolution, with the aid of slits and collimators provided to improve the optical characteristics of the degraded beam. Nevertheless, by using such elements, it is observed that the intensity of the beam is further reduced, also causing a large activation of the various elements.

The document "Three-dimensional Beam Scanning for Proton Therapy" from Kanai et al. published in Nuclear Instruments and Methods in Physic Research (Sep. 1, 1983), The Netherlands, Vol. 214, No. 23, pp. 491–496 discloses the use of a synchrotron which produces a beam of protons controlled by means of scanning magnets, which is then directed towards an energy degrader having as function to modify the energy characteristics of the proton beam. This degrader substantially consists of a block of material whose thickness is discretely variable. Nevertheless, this application does not propose to perform a continuous variation of the energy of the beam extracted from a particle accelerator, and in particular a fixed-energy particle accelerator.

AIMS OF THE INVENTION

The present invention aims to provide a device which would make it possible to vary the energy of the beam extracted from a particle accelerator, in particular from a fixed-energy particle accelerator.

More particularly, the present invention aims to provide a device which would make it possible to vary almost continuously the energy of a beam extracted from a particle accelerator.

MAIN CHARACTERISTICS OF THE INVENTION

The present invention relates to a process and a device for varying the energy of a particle beam extracted from a fixed-energy particle accelerator. With this aim, an energy degrader is inserted in the path of the particle beam extracted from the accelerator, this degrader substantially consisting of a block of material, the thickness of which is discretely variable by steps. The thickness is defined as the distance between the entry face and the exit face on the block of material.

The energy difference between the steps is variable and is determined such that the variation in the intensity of the beam reaches, at the limit between two consecutive steps, a maximum of 15% and typically 10% of the maximum intensity obtained at the exit of each of the two successive steps under consideration. This makes it possible to obtain a continuous variation of the energy despite the fact that the thickness varies discretely. Indeed, this is due to the combination of the way of calculating the energy difference between the steps with the association of an analysis element.

According to one preferred embodiment, this degrader is positioned at the point at which there is a narrowing ("waist") of the beam envelope. In addition, the curvature of the entry and exit faces of the degrader, defined by the height of the discrete levels or steps, is designed such that the "waist" is always for each step or level at the ideal position relative to the entry and exit faces without requiring the modification of the beam transport control parameters, and in particular the position of the "waist", from one step to the next.

This advantageously allows to keep the characteristics in energy dispersion and the optical qualities of the beam.

The energy degrader preferably has steps or levels of variable width, the width of a step being defined as the distance between two successive steps. This width should be adjusted such that it is slightly larger than the diameter of the beam entering or exiting the degrader, which means that the width of said steps or levels of large thickness will be greater than the width of said steps or levels of small thickness.

The material of which the energy degrader is made should have a high density and a low atomic mass. Examples may be diamond, aggregated diamond powder or graphite.

An analysis magnet may also conventionally be combined with this energy degrader.

BRIEF DESCRIPTION OF THE FIGURES

FIGS. 1*a* and 1*b* represent, respectively, a perspective view and a top view of an energy degrader used in the process for varying the energy of a particle beam according to the present invention, while

DETAILED DESCRIPTION OF ONE PREFERRED EMBODIMENT OF THE INVENTION

The present invention will be described in greater detail with reference to the figures which represent one particularly preferred embodiment of the present invention.

Figure 1A:
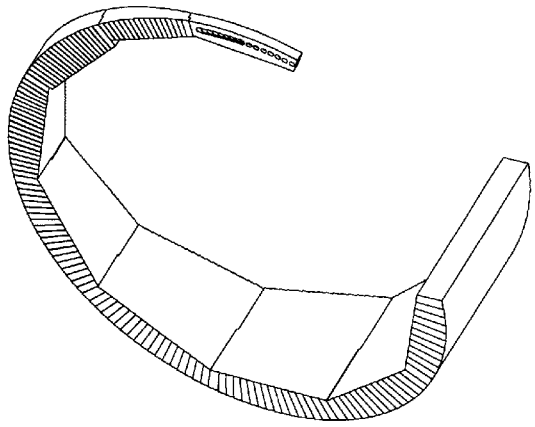
Figure 1B:
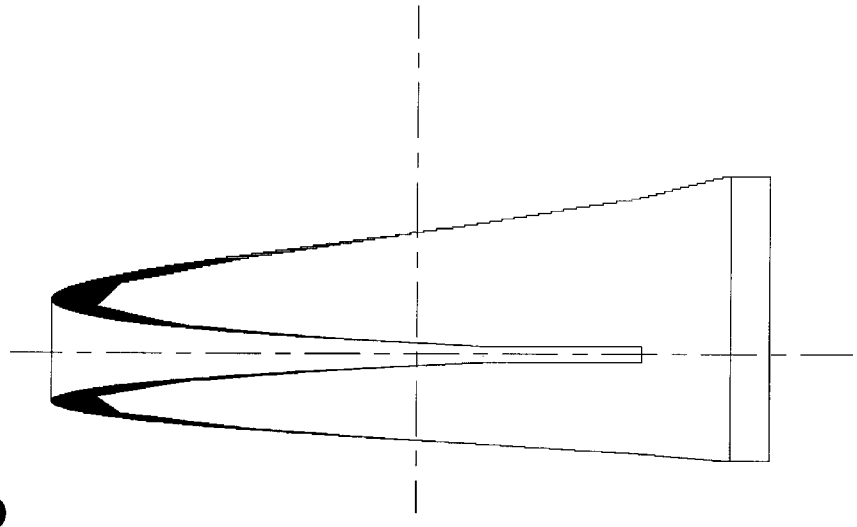

FIGS. 1*a* and 1*b* represent a degrader used in the device according to the present invention, substantially consisting of a block of material, the thickness of which is discretely variable by steps. This energy degrader will make it possible to roughly determine the desired energy value. Usually, an analysis magnet will be added to this energy degrader downstream said degrader, so as to allow finer adjustment of the desired energy value.

Figure 1C:
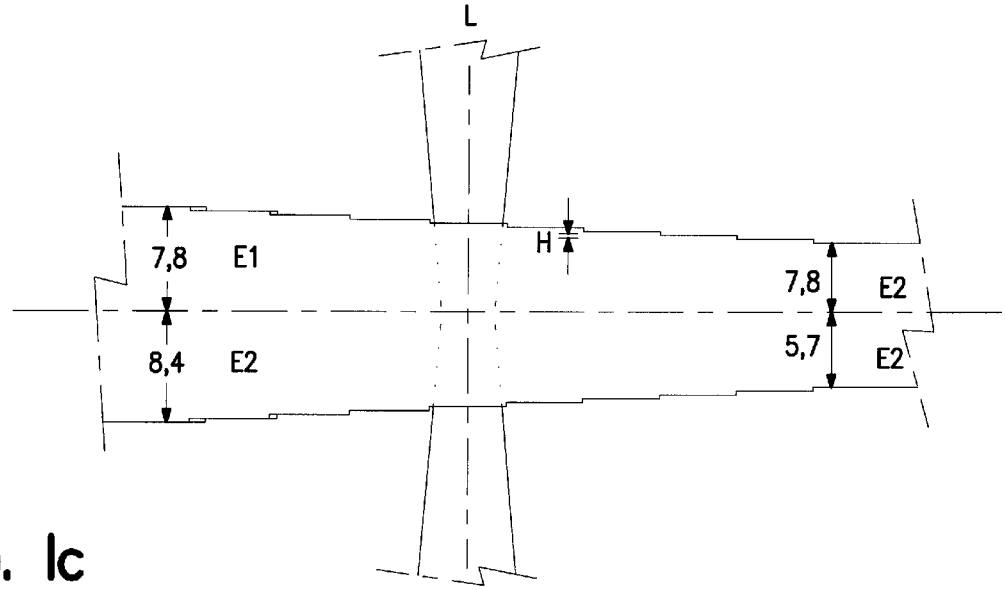
FIG. 1*c* represents an enlargement of a portion of FIG. 1*b*.

As represented in FIG. 1*c*, the energy degrader according to the invention is of "staircase" shape, for which each level or "step" has a different thickness corresponding to a given energy variation, the thickness E1+E2 being defined as the distance between the entry face and the exit face of the particle beam. Moreover, the width L of the successive steps is variable, and increases as a function of the thickness of said steps. The third parameter is the height H from one level or step to another.

This block of variable thickness is preferably in the form of a ring arranged on a wheel. This makes it possible to dispense with the discrete nature of the degrader while at the same time keeping parallel the entry and exit faces of said degrader, thereby minimizing the energy dispersion of the beam.

In this way, it is possible to construct a twin-"staircase" degrader, the thickness of which varies discretely, thus making it possible to keep the entry and exit faces parallel so as to minimize the energy dispersion.

When a mono-energetic proton beam passes through a material with fixed thickness, the energy dispersion resulting therefrom is reflected, as the beam leaves the block of material, by an energy spectrum of Gaussian distribution, characterizing the variation in current density (value In represented in FIG. 2 for the "step" n) as a function of the energy. This Gaussian distribution is centred on an energy value (value En represented in FIG. 2, for the "step" n) which corresponds to the initial energy minus the amount of the energy lost in the material, as may be calculated using path tables (known as "range tables").

Figure 2:
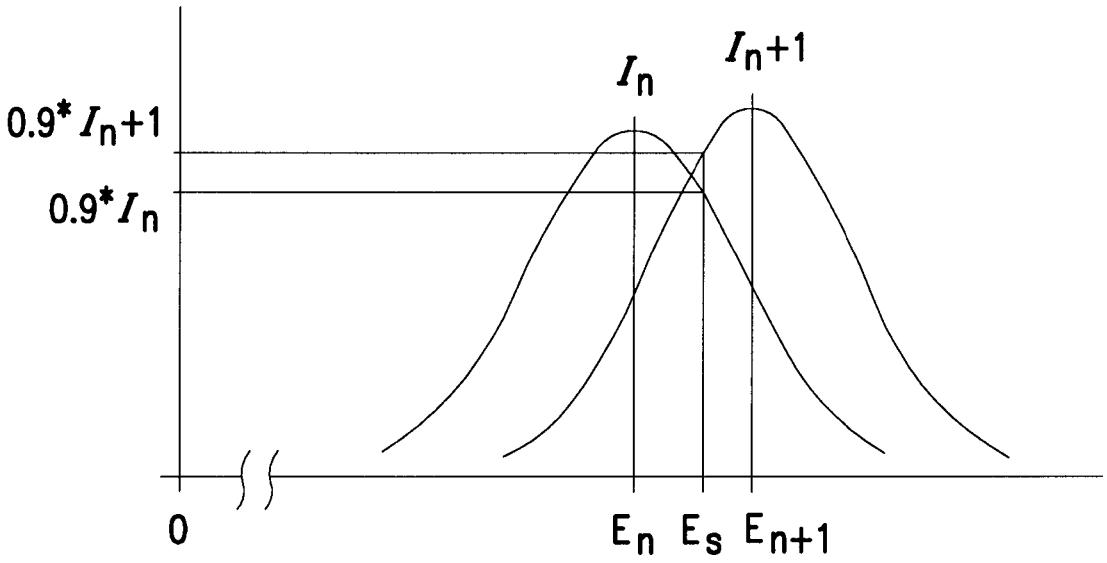
FIG. 2 represents the variation in current density as a function of the energy for a proton beam.

According to one embodiment, the step of the energy variation is determined such that the reduction in the intensity of the beam reaches a maximum of x% (typically 10%) at the edges of each step. Imposing this constraint allows to calculate the upper energy limit Es for a given step, which is also the lower energy limit for the next step (FIG. 2). An iterative calculation thus defines the number of "steps" required to obtain a continuous variation in energy between the maximum value (that of the beam extracted from the accelerator) and the minimum value (the lowest energy which will be used in the context of the application under consideration).

Advantageously, a continuous energy variation is obtained according to the present invention by placing, according to one preferred embodiment of the invention, an analysis magnet downstream the degrader, despite the fact that the thickness of the degrader varies in discrete steps. The principle is that, on account of the large energy dispersion associated with the "straggling", the degrader will define the energy only roughly, the fine adjustment being made downstream, by means of the analysis magnet.

The positioning of the degrader in the path of the beam is also of great importance in this regard. With this aim, in order to minimize the contribution of the divergence induced by the degrader on the emittance of the beam on exiting, the variable-thickness degrader will be located at exactly the position at which the beam envelope shows a narrowing (that is to say the position at which the beam has the smallest spatial extension, this position being known as the "waist"). The beam must thus be focused in the degrader, and each variable-thickness portion of the degrader, that is to say each "step" corresponding to a given energy decrease, is located at a position such that the distance between the entry face of the step and the position where the beam focuses (that is to say the waist) corresponds exactly to the distance which minimizes the exit emittance of the beam as calculated by the transport equations and the scattering theory.

An important aspect of the present invention is therefore that the optics of the beam are not changed, and in particular the position of the waist, as a function of the energy variation which it is desired to produce. By means of appropriate curvature of the entry and exit faces (that is to say by means of the shape of the entry and exit "staircases"), the waist remains spatially static and always occupies, for each step, the ideal position relative to the entry and exit faces of the step.

It is thus observed that E1 is not necessarily equal to E2 as represented in FIG. 1*c*.

The degrader is advantageously composed of a material of very low atomic mass and of high density in order to reduce the effects of multiple scattering.

This wheel is automated and remote-controlled so as to place, in the path of the incident beam, the part of the degrader (the "step"), the thickness of which corresponds to the energy loss one desires to bring about.

Figure 3:
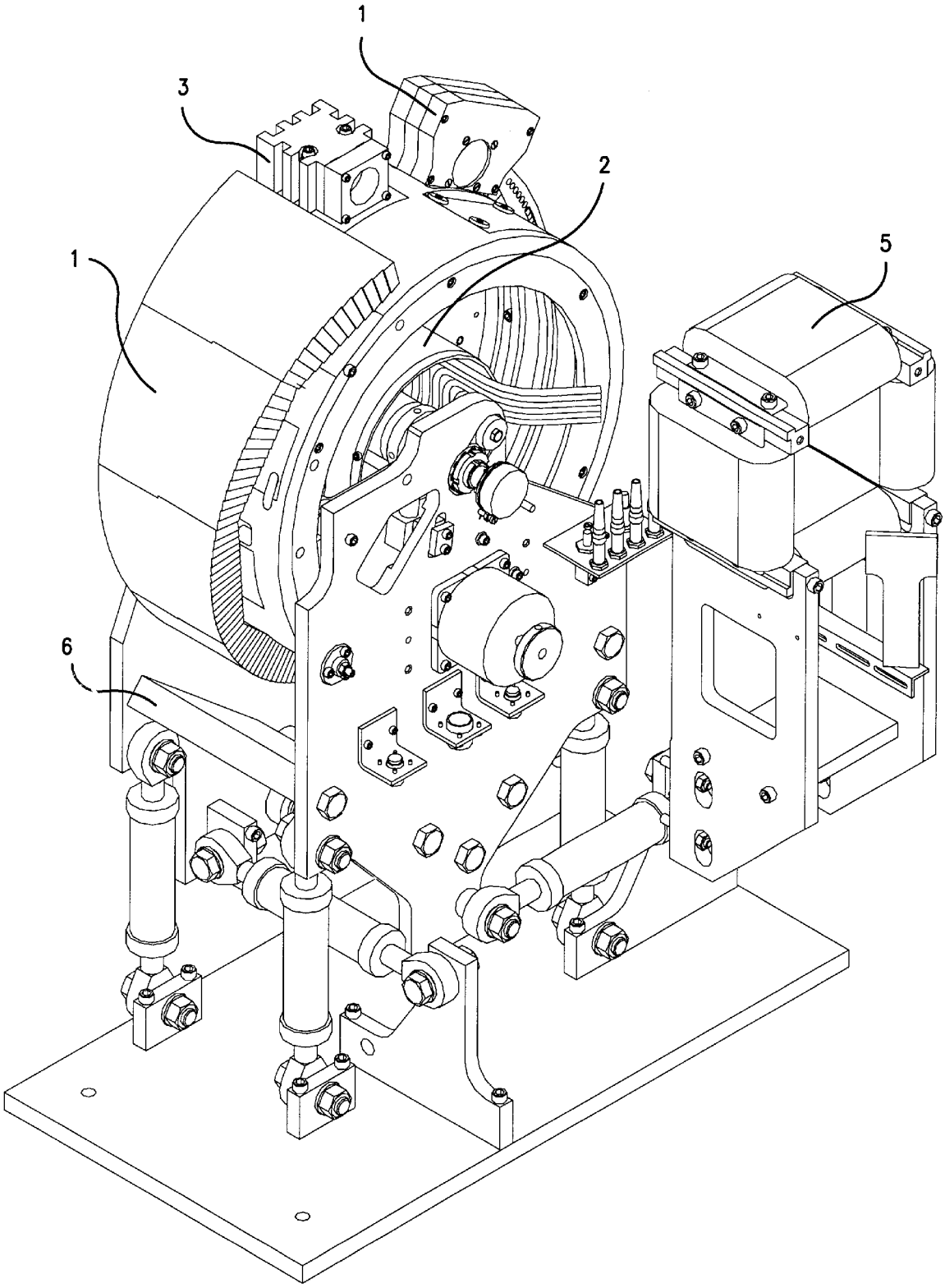
FIG. 3 represents an overall view of the device according to the present invention used in proton therapy.

FIG. 3 represents a diagram of the device for the purpose of using it in proton therapy. It has been sized so as to allow continuous variation, in the range 70 MeV–230 MeV, of the energy of a fixed-energy proton beam (about 230 MeV) produced by a cyclotron.

The device comprises the degrader 1 mounted on an automated wheel and made of graphite. It is composed of 154 "steps". Elements for controlling the characteristics of the beam, such as beam profile monitors 4 and beam stops 3, will also be found on this wheel. The assembly also comprises the supporting structure 6, correcting magnets ("steering" magnets, 5) and supply cables 2, in addition to a number of connectors.

What is claimed is:

1. Device for varying the energy of a particle beam extracted from a particle accelerator, comprising an energy degrader substantially consisting of a block of material, the thickness of which (E1+E2) is discretely variable by steps, characterized in that the energy difference between the steps is variable and is determined such that the variation in the intensity of the beam reaches, at the limit between two consecutive steps, a maximum of 15%, and preferably a maximum of 10%, of the maximum intensity obtained at the exit of each of the two adjacent steps under consideration.

2. Device according to claim 1, characterized in that the entry and exit faces for each discrete step of the energy degrader are parallel.

3. Device according to claim 1, characterized in that the particle beam is defined in a direction generally perpendicular to the path of the particle beam by a beam envelope and the degrader is located at a point at which the beam envelope presents a waist.

4. Device according to claim 3, characterized in that the curvature of the faces constituting the height (H) of the discrete steps of the degrader for the degrader entry and exit is designed such that the point at which the beam envelope has a waist is ideally positioned for each step relative to the entry and exit faces, so that the beam emittance is minimised.

5. Device according to claim 1, characterized in that the degrader has steps of variable width (L), the width of each step being determined so as to be slightly larger than the diameter of the beam entering or exiting the degrader.

6. Device according to claim 5, characterized in that the width (L) of the steps increases as a function of the thickness of said steps.

7. Device according to claim 1, characterized in that the degrader is made of a material of high density and low atomic mass selected from the group consisting of diamond, aggregated diamond powder, and graphite.

8. Device according to claim 1, characterized in that the degrader is mounted on an automated wheel.

9. Device according to claim 8, characterized in that the wheel on which the degrader is mounted has beam diagnosis elements comprising beam profile monitors or beam stops.

10. Device according to claim 1, further comprising an analysis magnet.

11. Device according to claim 1, wherein the degrader is made of a material of high density and low atomic mass.

12. A method for producing substantially continuous variation of the energy of a particle beam extracted from a fixed energy particle accelerator comprising the steps of:

positioning a block of energy degrading material in the path of the particle beam, said block having a thickness between parallel entry and exit faces which is variable in discrete steps to define a staircase configuration in which each step imparts a variable energy difference to the particle beam and said variable energy difference reaches a maximum energy difference at a limit of each step, so that the maximum energy difference of a step is approximately equal to a minimum energy difference of a succeeding step; and rotating said block to position successive steps in the path of the particle beam.

13. The method of claim 12, wherein said fixed energy particle accelerator is a cyclotron.

* * * * *